US005790997A

United States Patent [19]

Ruehl

[11] Patent Number: 5,790,997

[45] Date of Patent: Aug. 11, 1998

[54] TABLE/CHAIR EGRESS DEVICE

[75] Inventor: John W. Ruehl, Shelbyville, Ind.

[73] Assignee: Hill-Rom Inc., Batesville, Ind.

[21] Appl. No.: 511,308

[22] Filed: Aug. 4, 1995

[51] Int. Cl.[6] ..... A47B 7/02

[52] U.S. Cl. ..... 5/618; 297/83; 297/354.13; 297/316; 297/330

[58] Field of Search ..... 5/618, 617, 624; 297/60, 83, 354.13, 342, 316, 330, 343, 423.2, 423.28

[56] References Cited

U.S. PATENT DOCUMENTS

| | | | |
|---|---|---|---|
| 10,906 | 3/1854 | Case . | |
| 1,398,203 | 11/1921 | Schmidt . | |
| 2,913,300 | 11/1959 | Darnell et al. . | |
| 3,220,021 | 11/1965 | Nelson . | |
| 3,220,022 | 11/1965 | Nelson . | |
| 3,281,141 | 10/1966 | Smiley et al. . | |
| 3,406,772 | 10/1968 | Ahrent et al. . | |
| 3,593,350 | 7/1971 | Knight et al. . | |
| 3,821,821 | 7/1974 | Burst et al. . | |
| 4,097,940 | 7/1978 | Tekulve et al. . | |
| 4,127,906 | 12/1978 | Zur . | |
| 4,139,917 | 2/1979 | Fenwick . | |
| 4,183,109 | 1/1980 | Howell . | |
| 4,312,500 | 1/1982 | Janssen . | |
| 4,376,316 | 3/1983 | Mercier et al. . | |
| 4,409,695 | 10/1983 | Johnston et al. . | |
| 4,411,035 | 10/1983 | Fenwick . | |
| 4,558,857 | 12/1985 | Heller | 5/618 |
| 4,559,655 | 12/1985 | Peck . | |
| 4,559,656 | 12/1985 | Foster . | |
| 4,572,573 | 2/1986 | Yoshikawa | 297/83 |
| 4,592,104 | 6/1986 | Foster et al. . | |
| 4,637,652 | 1/1987 | Bergenwall | 297/330 |
| 4,711,486 | 12/1987 | Fujyiama | 297/330 |
| 4,751,754 | 6/1988 | Bailey et al. . | |
| 4,847,929 | 7/1989 | Pupovic . | |
| 4,862,529 | 9/1989 | Peck . | |
| 4,894,876 | 1/1990 | Fenwick . | |
| 4,937,900 | 7/1990 | Bridges | 297/330 |
| 4,944,055 | 7/1990 | Shainfeld . | |
| 5,072,463 | 12/1991 | Willis . | |
| 5,181,762 | 1/1993 | Beumer | 297/330 |
| 5,279,010 | 1/1994 | Ferrand et al. . | |
| 5,398,357 | 3/1995 | Foster . | |
| 5,454,126 | 10/1995 | Foster et al. . | |
| 5,537,701 | 7/1996 | Elliott . | |

*Primary Examiner*—Flemming Saether
*Attorney, Agent, or Firm*—Barnes & Thornburg

[57] ABSTRACT

A table including an articulated deck having a head section, a seat section, a foot section and at least one of the sections is coupled to the frame for movement between a generally horizontal position and a tilted position about a first effective axis above a patient support surface of a mattress of the deck. Pivoting and translation of the deck section extends and contracts the deck sections relative to each other to match the expansion and contraction of the skin of patient as the deck sections move between their horizontal and tilted positions.

18 Claims, 4 Drawing Sheets

TABLE/CHAIR EGRESS DEVICE

BACKGROUND AND SUMMARY OF THE INVENTION

The invention relates generally to a tablebed, stretcher, or planar surface that can be converted to a chair. The structure is primarily useful for facilitating in getting a patient from a supine position on the planar surface to a standing and/or walking position.

Beds or tables convertible to chairs are well-known in the prior art. A typical examples, U.S. Pat. No. 1,398,203 to Schmidt is a mechanical linkage system which moves back or head, seat and foot sections from a planar to a chair position. More recent developments involve individually controlling the segments of the chairbed. A typical example is U.S. Pat. No. 4,862,529 to Peck which shows separate drives to raise and lower the frame relative to the base as well as individually controlling the back or head section separate from the seat, thighs and foot section using individual hydraulic cylinders. Another example of a bed having multiple uses is the multi-purpose maternity care bed of U.S. Pat. No. 4,894,876 to Fenwick. This patent uses a plurality of electric motors to raise and lower the frame as well as articulate the back or head, seat and foot section of the deck relative to each other. A simplified system is illustrated in U.S. Pat. No. 5,072,463 to Willis. A first drive and parallelogram linkage pivots the seat and feet relative to the back portion. A second drive pivots the back or head section portion relative to the frame.

Generally, the convertible chair beds of the prior art are mechanically complicated and over designed to perform a multiple of functions. They include more than one driver to convert between a chair and a bed. This provides multiple elements which increases the cost and weight as well as the maintenance of the system.

Another problem being addressed by articulated decks, whether they are chair beds or just manipulated beds, is the shear between the patient body and the surface of the bed. The relative movement between the body and the surface of the bed can and does cause injuries to some patients, specifically older patients who have very thin skin. Various methods in the prior art have been used as an attempt to address the reduction of shear. At least one method translated the pivot point of the back section of the deck relative to the seat section longitudinally during pivoting. Since the connection of the pivot point was at the bottom of the mattress, this did not produce an effective axis rotation above the support surface of the mattress. A sectional mattress bed has had an arcuate path for the pivot point such as to produce an effective pivot at the surface. A typical example is U.S. Pat. No. 4,183,109 to Howell. Although providing the improvement at the pivotal juncture of the seat and back section, the shear at the foot section is not addressed. The ultimate goal is to produce an effective axis of rotation matching the axis rotation of the hip and knees of the bed occupant.

Thus, it is an object of the present invention to provide an articulated deck having effective pivots matching the pivoting joints of the occupant.

Another object of the present invention is to provide an articulated deck which is inexpensive.

An even further object of the present invention is to provide an articulated deck which is lightweight.

An even further object of the present invention is to provide an articulated deck which has shearless pivots corresponding to the knee and the hip of the patient which is inexpensive and lightweight.

These and other objects of the invention are obtained by providing a table including an articulated deck having a head section, a seat section, a foot section and at least one of the sections is coupled to the frame for movement between a generally horizontal position and a tilted position about a first effective axis above a patient support surface of a mattress of the deck. Pivoting and translation of the deck section extends and contracts the deck sections relative to each other to match the expansion and contraction of the skin of patient as the deck sections move between their horizontal and tilted positions.

Wherein the deck section is a back section, the seat and back section of the deck move away from each other when rotating up from the horizontal position to the tilted position. Wherein the deck section is the foot section, the seat and foot deck sections move closer to each other as the foot section pivots from a horizontal to a tilted position. The foot and head section move in the reverse direction relative to the seat section when they rotate from their tiled to their horizontal position.

Preferably, the table includes a base and a support platform mounted on the base including at least a head, seat and foot sections movable relative to each other. The seat section is mounted for vertical movement relative the base, the head section being mounted for pivotal movement relative to the seat section and the foot section being mounted for pivotal movement relative to the seat section. Linkage interconnects the base and the platform for raising and lowering the seat relative to the base and pivoting the back and foot sections relative to the seat to convert the platform to and between planar positions and a chair position.

The support platform includes a frame connected to the base for pivotal movement between a generally planar table position and a tilted chair position. The back section is fixed to the frame. The pivotal mounting of the back and seat section moves parallel to the plane of the frame. The foot section is connected to the frame by a linkage. The pivotal mounting of the foot and seat section moves in a plane parallel to the seat section and transverse to the plane of the frame. The pivotal mounting of the back and seat sections is connected to the base by linkage.

With the above linkage, a single driver, coupled to the frame and the base, moves the frame relative to the base and raising and lowering the seat section relative to the base and pivoting the back and foot sections to convert platform to and between the general planar table position and the chair position. The linkage moves the head and seat sections away from each other and the foot and seat sections towards each other when converting the platform from a planar table position to the chair position and reverse when converting from the chair to the planar table positions. The translation rotation produces the effective pivot points substantially above the support surface.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
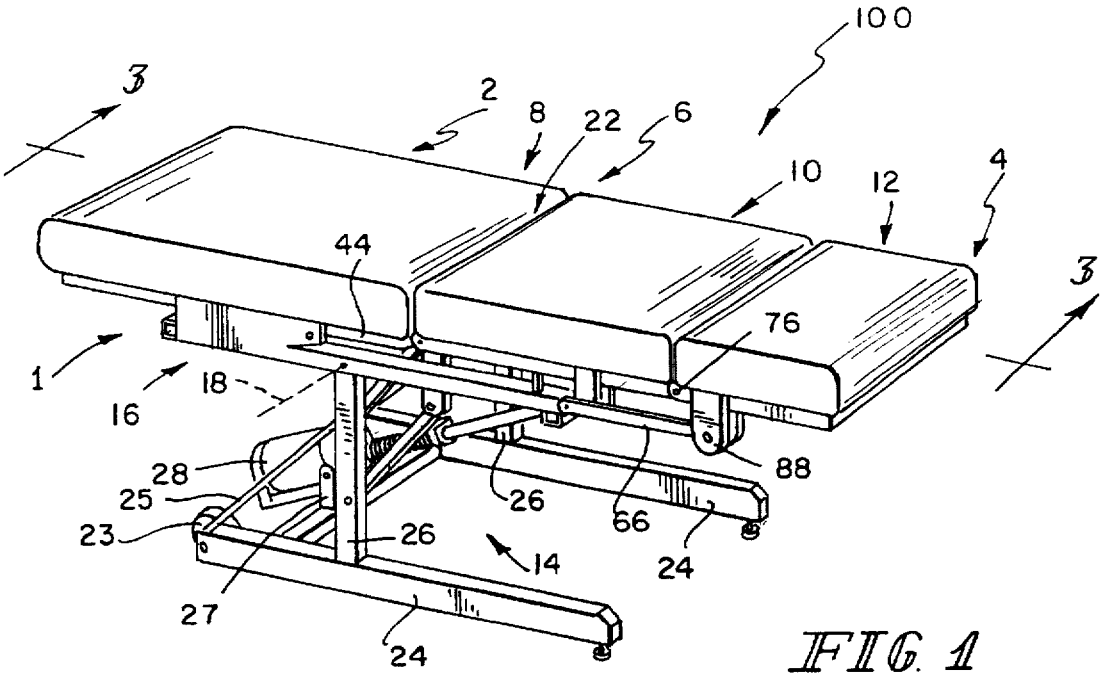
FIG. 1 is a perspective view of a table in a generally horizontal support or bed position incorporating the principles of the present invention.
Figure 2:
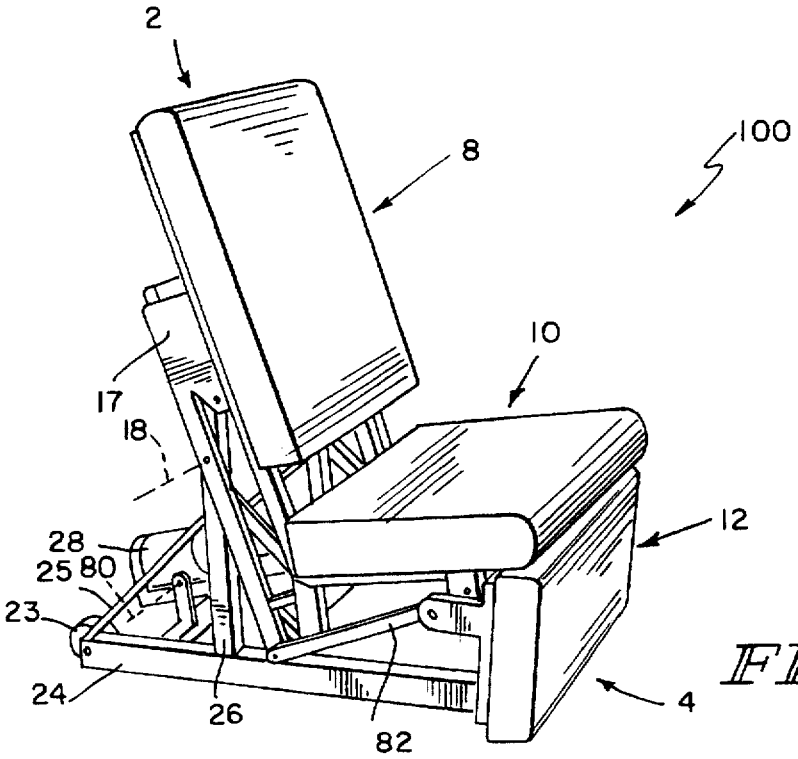
FIG. 2 is a perspective view of a table of FIG. 1 in a sitting or chair position.
Figure 3:
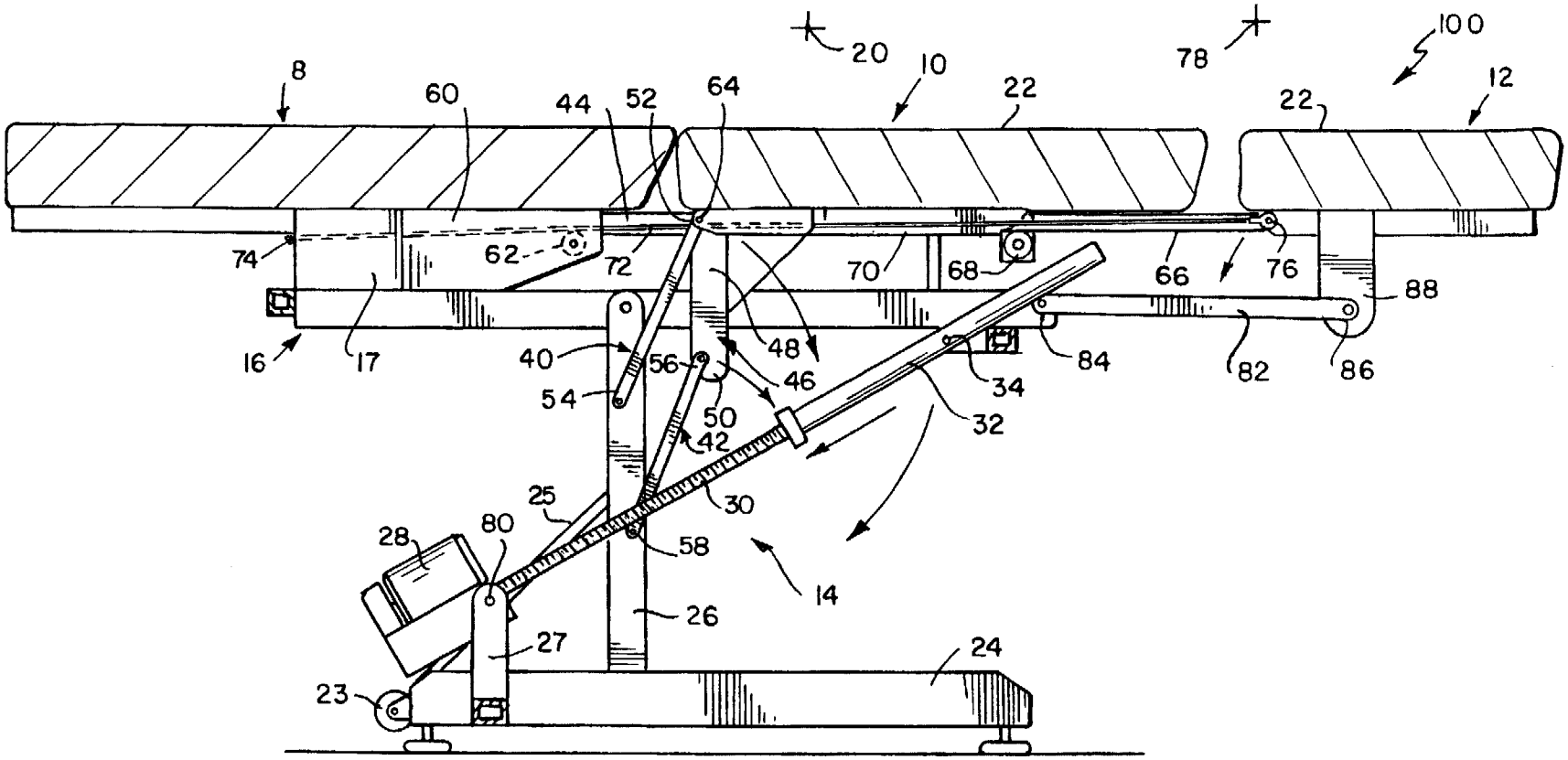
FIG. 3 is a sectional view taken along lines 3—3 of FIG. 1.
Figure 4:
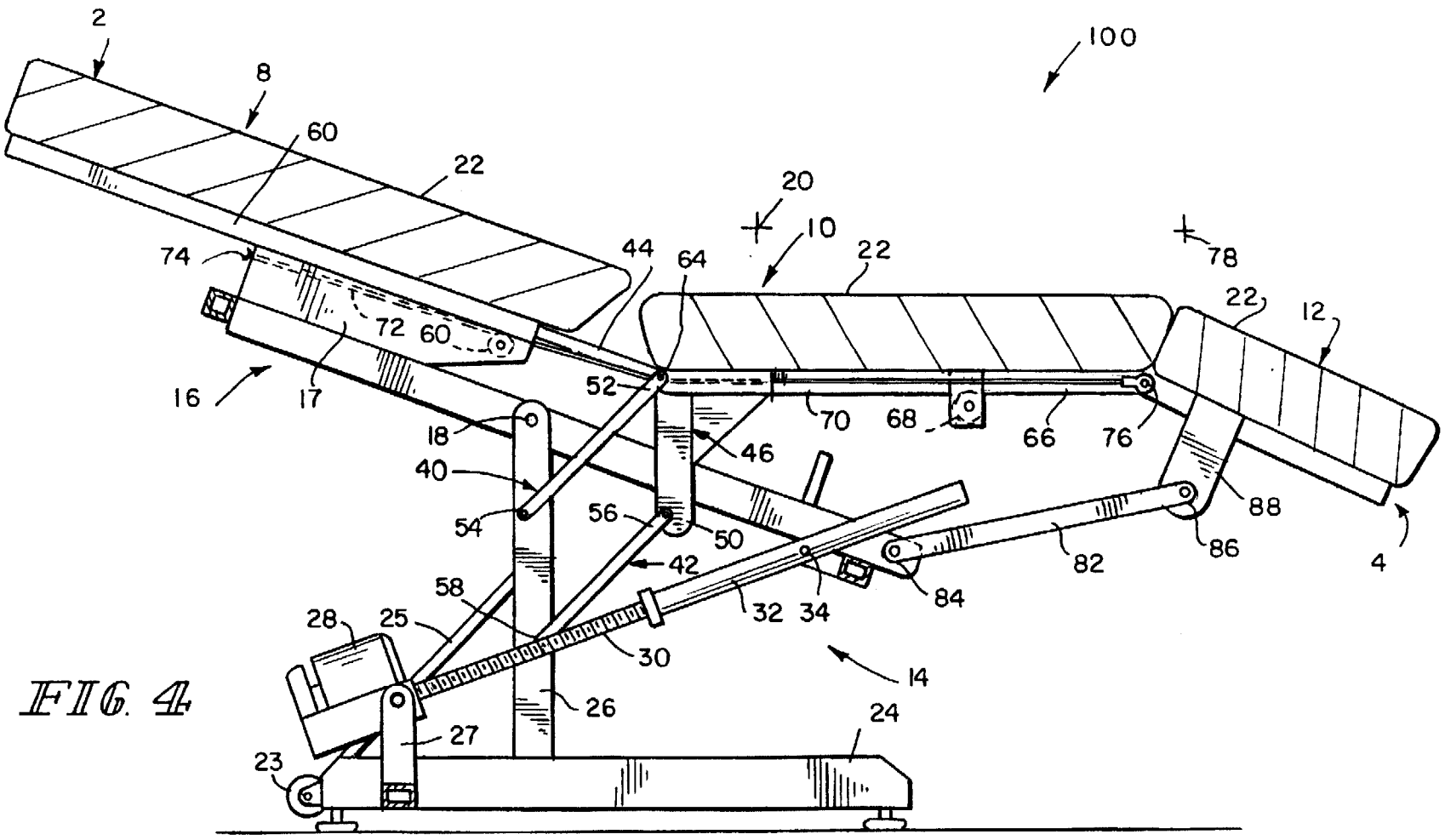
FIG. 4 is a sectional view showing the table in an intermediate position.
Figure 5:
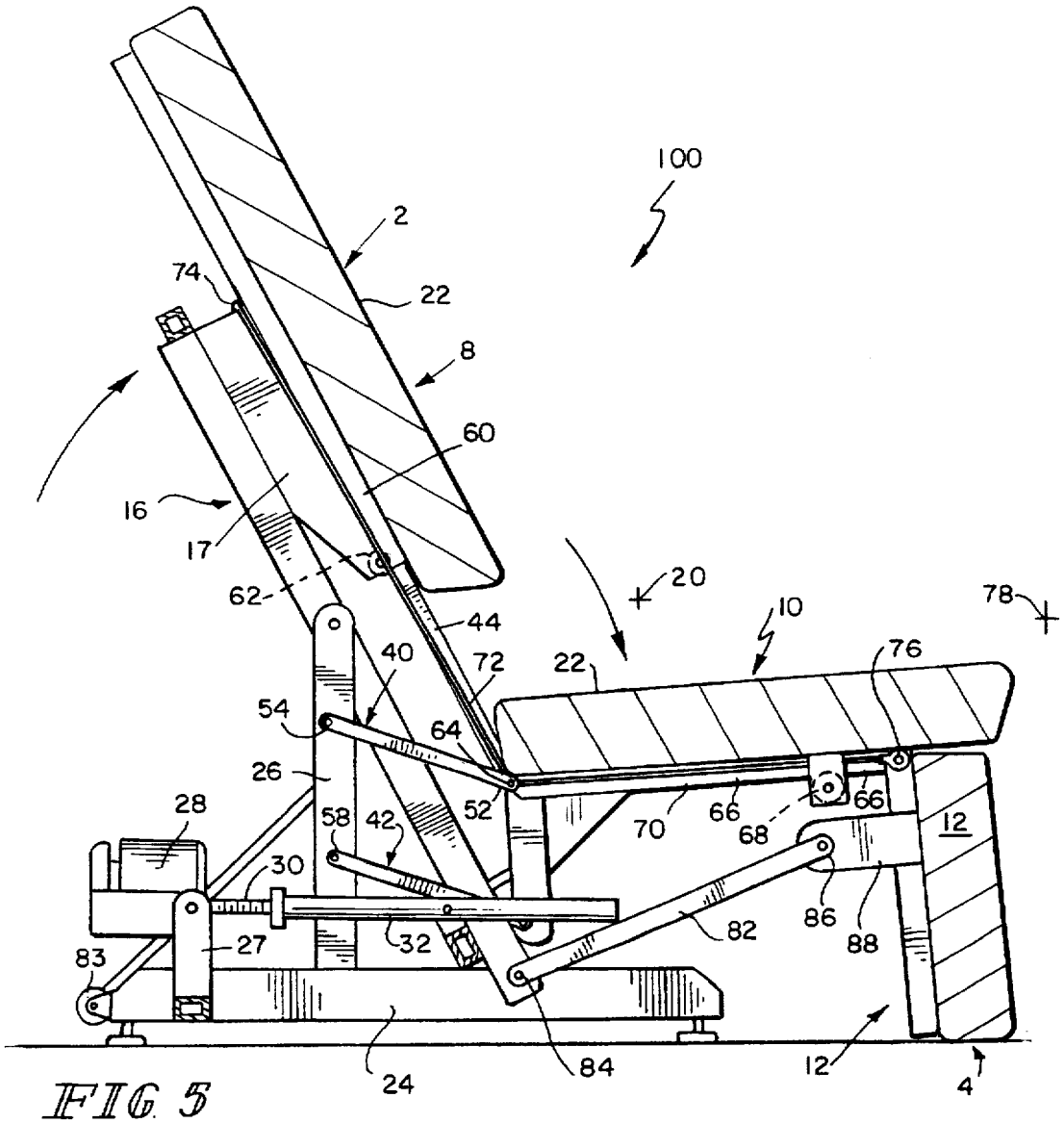
FIG. 5 is a sectional view showing the table in the sitting or chair position of FIG. 2.

A reduced-shear pivot assembly 14 is shown included on an examination table 100 having a head end 2, a foot end 4, and an articulating deck 6, including a head section 8, a seat section 10, and a foot section 12 as shown in FIGS. 1–6. Examination table 100 is convertible between an examination position having deck 6 in a generally planar configuration as shown in FIGS. 1, 3 and a sitting position as shown in FIGS. 2, 5. Head section 8 moves between a generally horizontal down position shown in FIG. 1 and an upward back-support position shown in FIG. 2, and foot section 12 moves between a generally horizontal up position shown in FIG. 1 and a generally vertically downwardly extending down position shown in FIG. 2.

Head section 8 and foot section 12 are both provided with a reduced shear pivot assembly 14, shown best in FIGS. 3–6, that operates to pivot head section 8 relative to seat section 10 about an effective pivot axis 20 that is positioned to lie above an examination or support surface 22 and that also operates to pivot foot section 12 relative to seat section 10 about an effective pivot axis 78 that is positioned to lie above examination or support surface 22.

Although the reduced shear pivot assembly 14 is described with respect to an examination table, it can also be used in a bed, a chair bed, a stretcher, a gurney or any other device having an articulated deck including one or more articulated deck sections wherein the pivot corresponds to the pivoting of a person on the deck.

Examination table 1 includes a base platform 24 having upstanding posts 26 fixed thereto and extending upwardly therefrom. The upstanding posts 26 are secured to the base 24 by diagonal braces 25. The base platform 24 is shown resting on the ground. Wheels 23 are provided at the back end of the base 24 displaced from the ground when the base 24 is in its horizontal position. To move the table, the table is rotated up such that the base 24 pivots back onto the wheel 23. Then, the table can be moved to any desired location. This movement is preferable when in the chair position of FIG. 2 with an occupant therein. It is not recommended to transport of the table in its supine position of FIG. 1 on wheel 23 with an occupant thereon. Alternatively, wheels may be provided at the four ends of the base 24 so as to make the table portable without tilting. This will allow the table to be used as a gurney in an emergency department wherein the patient is brought in from the ambulance, moved into an emergency bay, then moved out to a room or surgery center without moving from one conveyance to another.

Reduced-shear pivot assembly 14 includes a frame 16 pivotably attached to a pair of spaced upstanding posts 26 for pivoting movement relative thereto about a pivot axis 18. A drive motor 28 is pivotably attached to base platform 24 by bracket 27 for pivoting movement about a pivot axis 80. Drive motor 28 is configured to rotatably drive a lead screw 30 that angles upwardly from drive motor 28 to a sheath 32 that is coupled to frame 16 for pivoting movement about a pivot axis 34.

Sheath 32 is formed to include an interior region (not shown) that threadably receives lead screw 30 as shown in FIG. 3. Extension of lead screw 30 from sheath 32 by rotating causes frame 16 to pivot relative to base platform 24 about pivot axis 18 with foot end 4 of frame 16 pivoting upwardly and head end 2 of frame 16 pivoting downwardly. Likewise, retraction of lead screw 30 into sheath 32 cause frame 16 to pivot about pivot axis 18 with foot end 4 of frame 16 pivoting downwardly and head end 2 of frame 16 pivoting upwardly.

Head section 8 of articulating deck 6 is fixed to frame 16 by flanges 17 as shown in FIGS. 3–6. As frame 16 pivots from a generally horizontal initial position shown in FIG. 3 to an inclined position shown in FIG. 5 having head end 2 of frame 16 positioned above foot end 4 of frame 16, head section 8 pivots from a generally horizontal down position of FIG. 1 to an upward back-support position of FIG. 2.

The head end of seat section 10 is connected to upstanding posts 26 by transverse upper struts 40, transverse lower struts 42, and bracket 46. Bracket 46 includes a first end 48 fixed to head end of seat section 10 and extends downward to terminate at a second end 50. Each upper strut 40 has a first end 52 pivotably coupled to seat section 10 adjacent to first end 48 of bracket 46 and a second end 54 pivotably coupled to one of upstanding posts 26. Each lower strut 42 has a first end 56 pivotably coupled to second end 50 of bracket 46 and a second end 58 pivotably coupled to one of upstanding posts 26 beneath second end 54 of upper strut 40.

As can best be seen in FIGS. 3 and 5, the connection of the struts 40 and 42 at ends 54 and 58 respectfully to the upstanding post 26 are offset with respect to a vertical. The connection of the strut 40 and 42 at ends 52 and 56 to the bracket 46 are aligned vertically. The lengths of the struts 40 and 42 are substantially equal. As an alternative, the strut 40 and 42 may be of unequal length and their connection to the outstanding post 26 may be aligned vertically. As a further alternative, the connections may be offset and the struts lengths different. The lengths of the struts 40 and 42 and their connections to the upstanding posts 26 and to the bracket 26 are selected such that the seat section 10 is horizontal in the planar or horizontal position of the articulate deck 6 as shown in FIGS. 1 and 3 and the foot end of seat section 10 is raised with respect to the head end of seat section 10 in the chair position as illustrated in FIGS. 2 and 5. Thus, the struts 40, 42 do not form a true parallelogram with the upstanding post 26 and bracket 46. The raising of the knee with respect to the hip secures the occupant to the chair and prevents sliding out.

Figure 6:
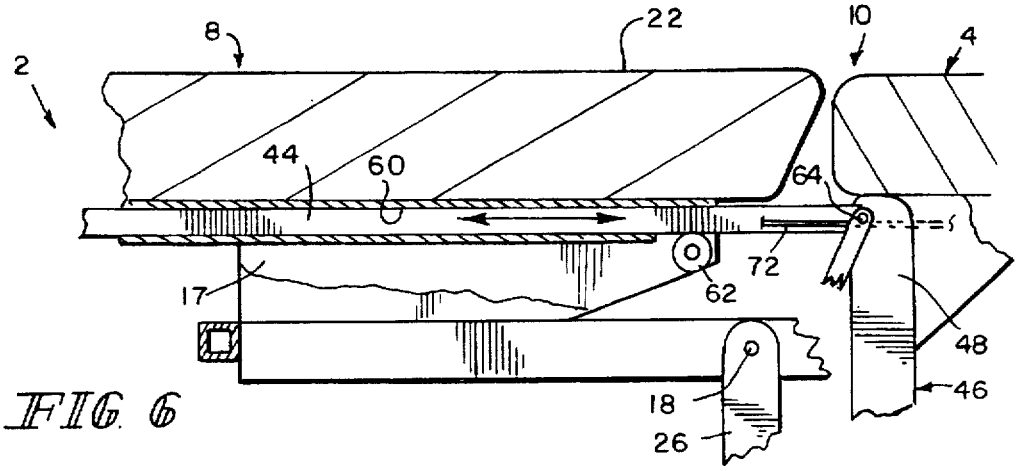
FIG. 6 is an enlarged view of a portion FIG. 1 showing the connection of seat and back sections of the deck.

First telescoping members 44 are slidably received by a sheath 60 appended to head section 8 and flange 17 of frame 16 as shown best in FIG. 6 for movement over rollers 62 between a retracted position shown in FIGS. 3 and 6, and an extended position shown in FIGS. 4 and 5. Each first telescoping member 44 includes a foot end 64 that is pivotably coupled to seat section 10 adjacent to first end 48 of bracket 46 and a head end (not shown) received by sheath 60. As first telescoping members 44 move between the retracted position and the extended position, seat section and head section translates relative to each other. Thus, the pivot point 64 of the seat and head sections moves alone a plane parallel to the frame 16.

Foot section 12 is pivotably coupled at head end 2 of foot section 12 to second telescoping members 66 at 76 as shown in FIGS. 3–5. Seat section 70 is formed to include sheaths 70 and each second telescoping member 66 is slidably received by a sheath 70 of the seat section 10 for movement over rollers 68 between an extended position shown in FIG. 3 and a retracted position shown in FIG. 5. As second telescoping members 66 move between the retracted position and the extended position, foot section 12 translates relative to seat section 10. Thus, the pivotal connection of the foot section 12 to the seat section 10 moves in a plane parallel to the seat section transfers to the plane of the frame 16. A link 82 is pivotably connected at a first end 84 to frame 16 and at a second end 86 to a bracket 88 extending from foot section 20 pivoting of the frame 16 pivots the foot section 12.

A cable 72 has a first end 76 fixed to head end of foot section 12 and a second end 74 fixed to flange 17 of head section 8. The length of cable 72 is fixed so that second telescoping members 66 move from the extended position to the retracted position when first telescoping members 44 move from the retracted position to the extended position. Consequently, cable 72, frame 16 and link 82 act to coordinate the movement of head section 8 and foot section 12 relative to seat section 10 so that as head section 8 translates and pivots upwardly relative to seat section 10, foot section 12 simultaneously translates and pivots downwardly relative to seat section 10.

Seat section 10 translates relative to head section 8 as head section 8 pivots from the down position to the back-support position as shown in FIGS. 2–5. The pivoting movement of head section 08 and the translational movement of seat section 10 combine to produce a motion in which head section 8 pivots relative to seat section 10 about effective pivot axis 20 positioned to lie above support surface 22 and coincident with a hip (not shown) of a person on the support surface 22.

Likewise, seat section 10 translates relative to foot section 12 as foot section 12 pivots from the up position to the down position as shown in FIGS. 2–5. The pivoting movement of foot section 12 and the translational movement of seat section 10 combine to produce a motion in which foot section 12 pivots relative to seat section 10 about a second effective pivot axis 78 positioned to lie above support surface 22 and coincident with a knee (not shown) of a person (not shown) on support surface 22.

The head section 8 is fixed to the frame 16 which pivots about a fixed pivot point 18 adjacent the foot end of head section 8 fixed to the base platform 24 and the seat section 10 moves relative to the head section 22 and frame 16. Thus, when the frame 16 pivots from the planar position of FIG. 1 to the sixty degree position of FIG. 2, the seat 22 is moved closer to the ground. This allows easy egress.

As can be seen, head section 8 translates relative to seat section 10 when head section 8 pivots from the down position to the back-support position. This relative translation effectively expands the length of deck 6 and support surface 22 at the junction of the head and seat sections 8 and 10, during the articulation of deck 6. The effective expansion of deck 6 and support surface 22 at the seat and head juncture conforms to the lengthening of the back of the person to minimize the shear that could take place between the person and surface 22. For the foot-seat juncture, the surface 22 contracts when moving from a lying position to a sitting position which corresponds to the concentration of the back of the legs.

In other words, the expansion of deck 6 and surface 22 at the back and contraction of the foot allows the lower body of the person to remain stationary relative to surface 22 when tilting the upper body of the person, which also remains stationary relative to surface 22, in order to minimize the scrubbing between the person and surface 22 during articulation of deck 6.

Thus, the translational movement of seat section 10 of examination table 1 relative to head and foot sections 8, 12 and contemporaneous with the pivoting movement of head and foot sections 8, 12 results in a reduced-shear pivoting movement of head and foot sections 8, 12. The effective pivot axes 20, 78 of head end foot sections 8, 12 lie above support surface 22. If effective pivot axes 20, 78 are approximately colinear with axis of rotation of hip and knee respectively, then the scrubbing of support surface 22 against the person (not shown) supported by support surface 22 will be minimized.

As can be noted from FIGS. 1–6, a minimum number of linkages are used and only a single motor 28 is used to simultaneously move the support surface 22 from its planar position illustrated in FIG. 1 to its chair position of FIG. 2 pivoting the head section 8 up, the foot section 12 down and lowering the seat section 10 closer to the ground. The single motor 28 with its screwdrive and the minimum number of links and brackets, substantially reduces the cost and weight of the table.

The table can be constructed of various widths and lengths depending upon its purpose. Also, if it is desired, the foot section 12 may be removable for certain types of examinations. If required, suitable side rails may be provided adjacent the head section 18 and the seat section 10. The rails would be configured so as to not engage as they rotate between the various positions. The side rails would have a raised restraint position and a lowered access or stored position.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A table having a generally planar table position and convertible to a chair position and permitting patient egress from a foot end thereof comprising:

a base;

a support platform mounted on said base and including at least head, seat and foot sections movable relative to each other and a frame pivotally connected to said base for movement between a generally planar table positon and tilted chair position;

said seat section being mounted for vertical movement relative to said base;

said head section being fixed to the frame and pivotally mounted for movement relative to said seat section parallel to the plane of the frame between a generally planar table position and a raised chair position;

said foot section being pivotally mounted for movement relative to said seat section between a generally planar table position to a lowered chair position; and linkage connected between said base and said platform for either raising the entire seat section or lowering the entire seat section relative to said base and pivoting said head and foot sections to convert said platform to and between the generally planar table position and the chair position.

2. A table according to claim 1, wherein said foot section is connected to said frame by a link and the pivotal mounting of the foot section relative to the seat section moves transverse to the plane of the frame.

3. A table according to claim 2, wherein the pivotal mounting of the head section relative to the seat section is connected to said base by linkage.

4. A table according to claim 1, wherein said foot section is connected to said frame by a link and the pivotal mounting of the foot section relative to the seat section moves parallel to the plane of the seat section.

5. A table according to claim 1, including a driver coupled to the frame and to the base to move the frame relative to the base for raising and lowering said seat section relative to said base and pivoting said head and foot sections to convert said platform to and between the generally planar table position and the chair position.

6. A table according to claim 1, wherein said linkage moves the head and seat section away from each other and the foot and seat section toward each other and vise verse when converting said platform to and between the generally planar table position and the chair position.

7. A table according to claim 1, including a mattress supported on the platform, the mattress including a support surface, and wherein said head and seat section and said seat and foot sections are coupled for movement between the generally planar table position and the chair position each about an effective pivot axis above the support surface.

8. A table having a head end, a foot end, and sides, the table comprising:

a frame pivotally mounted to a base;

an articulated deck supported by the frame, the deck having a head section, a seat section and a foot section pivotal relative to each other;

a mattress supported on the deck, the mattress including a support surface;

the head, seat and foot sections being coupled to the frame to produce pivotal and longitudinal movement of a portion of the support surface adjacent a pivotal connection for movement between a generally horizontal position and an tilted position of the head and seat sections;

the head section being fixed to the frame; and a pivotal coupling of the seat section relative to the head section moves parallel to the plane of the frame.

9. The table according to claim 8, wherein said head section is coupled to said seat section to extend relative to said seat section for movement between said generally horizontal position and said tilted position and to contract relative to said seat section for movement between said tilted position and said generally horizontal position.

10. The table according to claim 8, wherein said foot section is coupled to said seat section to contract relative to said seat section for movement between said generally horizontal position and said tilted position and to extend relative to said seat section for movement between said tilted position and said generally horizontal position.

11. A table having a head end, a foot end, and sides, the table comprising:

a frame pivotally connected to a base;

an articulated deck supported by the frame, the deck having a head section, a seat section and a foot section pivotal relative to each other;

the head section being fixed to said frame; and a pivotal coupling of the seat section relative to the head section moves parallel to the plane of the frame.

12. The table according to claim 11, wherein said head section is coupled to said seat section to extend relative to said seat section for movement between a generally horizontal position and a tilted position and to contract relative to said seat section for movement between said tilted position and said generally horizontal position.

13. The table according to claim 11, wherein said foot section is coupled to said seat section to contract relative to said seat section for movement between a generally horizontal position and a tilted position and to extend relative to said seat section for movement between said tilted position and said generally horizontal position.

14. A table according to claim 11, wherein said foot section is connected to said frame by a link and a pivotal coupling of the foot and seat sections moves transverse to the plane of the frame.

15. A table according to claim 14, wherein the pivotal coupling of the head and seat sections is connected to said base by linkage.

16. A table according to claim 11, wherein said foot section is connected to said frame by a link and a pivotal coupling of the foot and seat sections moves parallel to the plane of the seat section.

17. A table according to claim 11, including a driver coupled to the frame and to the base to move the frame relative to the base for raising and lowering said seat section relative to said base and pivoting said head and foot sections to convert said deck to and between a generally planar table position and a chair position.

18. A table according to claim 11, including linkage moving the head and seat section away from each other and the foot and seat section toward each other and vise verse when converting said deck to and between a generally planar table position and a chair position.

* * * * *